US008038475B2

(12) United States Patent
Kameyama et al.

(10) Patent No.: US 8,038,475 B2
(45) Date of Patent: Oct. 18, 2011

(54) SHIELD CONNECTOR

(75) Inventors: Isao Kameyama, Susono (JP); Motoo Nojima, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/420,097

(22) Filed: Apr. 8, 2009

(65) Prior Publication Data

US 2009/0258540 A1 Oct. 15, 2009

(30) Foreign Application Priority Data

Apr. 15, 2008 (JP) ..... 2008-105569

(51) Int. Cl.
*H01R 9/03* (2006.01)

(52) U.S. Cl. ..... 439/607.51; 439/607.58

(58) Field of Classification Search ..... 439/607.51, 439/607.41, 607.43, 607.58
See application file for complete search history.

(56) References Cited

U.S. PATENT DOCUMENTS 4,891,022 A * 1/1990 Chandler et al. ..... 439/607.51
6,821,151 B2 * 11/2004 Lai ..... 439/607.51
6,857,904 B2 * 2/2005 Lai ..... 439/607.43
7,232,341 B2 * 6/2007 Shinmyo ..... 439/607.51
7,267,578 B2 * 9/2007 Wu ..... 439/607.58
7,341,487 B2 * 3/2008 Wu ..... 439/607.51

FOREIGN PATENT DOCUMENTS

JP 2006-310164 A 11/2006

* cited by examiner

*Primary Examiner* — Hien Vu
(74) *Attorney, Agent, or Firm* — Sughrue Mion, PLLC

(57) ABSTRACT

A shield connector includes plural female terminals 2, a connector housing 3, and a shield shell 8. The connector housing 3 includes a terminal holder 6 that holds the plural female terminals 2 and an inner housing 5 into which the terminal holder 6 is inserted. The shield shell 8 includes an upper shield shell 25 and a lower shield shell that are attached to each other so as to cover the outer periphery of the inner housing 5. The upper shield shell 25 includes an extension wall 30 which detects the state where the terminal holder 6 is being inserted into the inner housing by overlapping with at least a part of a surface 6*a* of the terminal holder 6 on the rear end side in an insertion direction toward the inner housing 5 in the state where the upper shield shell is attached to the inner housing 5 and by coming into contact with the terminal holder 6 so as to regulate the upper shield shell 25 from being attached to the inner housing 5 in the state where the terminal holder 6 is being inserted into the inner housing 5.

3 Claims, 8 Drawing Sheets

SHIELD CONNECTOR

BACKGROUND OF THE INVENTION

1. Field of the Invention

The present invention relates to a shield connector used for carrying out an electric connection operation between electronic devices mounted to, for example, a vehicle or the like.

2. Description of the Related Art

Various electronic devices are mounted to an automobile that is a vehicle. For this reason, the automobile is provided with a wire harness used to transmit a power or a control signal to the above-described electronic devices. The wire harness includes plural electric wires and connectors attached to the electric wires.

The electric wire is a so-called coating wire that includes a conductive core wire and a coating portion formed of a synthetic resin so as to coat the core wire. The connector includes a terminal metal part that is formed of conductive metal and a connector housing which accommodates the terminal metal part. The connector housing is formed of an insulating synthetic resin, and is fitted to connectors of the above-described electronic devices. In the above-described wire harness, the connectors are fitted to the connectors of the electronic devices so as to transmit a desired power or signal to the electronic devices.

In the above-described automobile, for example, a navigation device is mounted as an electronic device. The navigation device includes a body part that calculates a current position or the like and a display that displays a current position or a target position. The body part and the display are connected to each other via the above-described wire harness. Since the display is required to have higher resolution and to display the current position or the like in real time, a signal amount transmitted from the body part to the display tends to increase.

For this reason, a connector that is used to connect the body part to the display of the above-described navigation device needs to transmit a large amount of signal at a high speed. Thus, in the above-described connector, it is important to provide a countermeasure for noise which prevents the case where electric noise leaks to the outside from a terminal metal part for transmitting a large amount of signal or electric noise enters from the terminal metal part to another terminal metal part.

As the above-described countermeasure for noise, for example, a shield connector shown in FIGS. 9 to 11 is proposed by the present applicant. A shield connector 100 shown in FIGS. 9 to 11 includes plural terminal metal parts 101; a connector housing 102 which includes a terminal holder 103 formed of an insulating synthetic resin so as to hold the plural terminal metal parts 101, an inner housing 104, and the outer housing 105; and a shield shell 106 which is formed of conductive metal.

Each terminal metal part 101 is formed of conductive metal so as to have a bar shape. The terminal holder 103 is formed of an insulating synthetic resin, and includes a holder body 110 which is formed in a cubic shape and includes a terminal accommodation groove 111 for accommodating the terminal metal part 101; a cover 112 which is attached to the holder body 110 and covers an electric wire (not shown) connected to the terminal metal part 101.

The inner housing 104 is formed in a rectangular tube shape of which one end is blocked and the terminal holder 103 is inserted therethrough. The outer housing 105 is formed in a rectangular tube shape in which the inner housing 104 and the shield shell 106 are accommodated. The shield shell 106 includes an upper shield shell 113 and a lower shield shell 116 that are attached to each other so as to cover the outer periphery of the inner housing 104.

The upper shield shell 113 is formed by bending, for example, a metal plate or the like, and includes a body portion 114 which is formed in an angular gutter shape (having a U-shape in a sectional view) 114 and plural extension walls 115 which extend from one end of the body portion 114. The lower shield shell 116 is formed by bending, for example, a metal plate or the like, and includes a body portion 117 which is formed in an angular gutter shape (having a U-shape in a sectional view) 117 and a cylindrical tube portion 118 which extends from one end of the body portion 117 and allows the electric wire connected to the terminal metal part 101 to pass therethrough.

The shield connector 100 having the above-described configuration is assembled as below. First, the terminal metal part 101 attached with the electric wire is accommodated in the terminal accommodation groove 111 so as to be attached to the holder body 110, and the cover is attached to the holder body 110, thereby holding the terminal metal part 101 in the terminal holder 103. Subsequently, the terminal holder 103 holding the terminal metal part 101 is inserted into the inner housing 104.

In addition, in the state where the upper shield shell 113 and the lower shield shell 116 are attached to each other so as to cover the outer periphery of the inner housing 104, the shield shell 106 is attached to the inner housing 104, and the inner housing 104 and the shield shell 106 are accommodated in the outer housing 105. In this manner, the shield connector 100 is assembled, and is fitted to an opposite connector (not shown).

In the shield connector 100 assembled as described above, electric noise leaking to the outside from the terminal metal part 101 and electric noise entering from the outside to the terminal metal part 101 are shielded by the shield shell 106.

However, in the above-described shield connector 100, when the upper shield shell 113 and the lower shield shell 116 of the shield shell 106 are attached to the inner housing 104, as shown in FIG. 11, the terminal holder 103 may come off from the inner housing 104, thereby causing a problem in that the shield connector 100 is erroneously assembled.

Accordingly, an object of the invention is to provide a shield connector capable of preventing occurrence of an erroneous assembling operation.

SUMMARY OF THE INVENTION

In order to solve the above-described problems and to achieve the above-described object, according to a first aspect of the invention, there is provided a shield connector including: plural terminal metal parts; an insulating connector housing which includes a holder for holding the plural terminal metal parts and an inner housing for allowing the holder to be inserted therethrough; and a conductive shield shell which is attached to the inner housing, wherein the shield shell includes a pair of shell members which is attached to each other so as to cover the outer periphery of the inner housing, and wherein one shell member of the pair of shell members includes a detection portion which detects the state where the holder is being inserted into the inner housing by overlapping with at least a part of a surface of the holder on the rear end side in an insertion direction toward the inner housing in the state where the one shell member is attached to the inner housing and by coming into contact with the holder so as to regulate the one shell member from being attached to the inner housing in the state where the holder is being inserted into the inner housing.

A second aspect of the invention provides the shield connector according to the first aspect, wherein a pair of the detection portions is respectively provided in one ends of the one shell member on the rear end side in the insertion direction of the holder so as to be opposed to each other with the inner housing interposed therebetween.

According to the first aspect of the invention, since one shell member of the pair of gutter-shaped shell members of the shield shell which are attached to each other so as to cover the outer periphery of the inner housing includes the detection portion which detects the state where the holder is being inserted into the inner housing by overlapping with at least a part of a surface of the holder on the rear end side in an insertion direction toward the inner housing in the state where the one shell member is attached to the inner housing and by coming into contact with the holder so as to regulate the one shell member from being attached to the inner housing in the state where the holder is being inserted into the inner housing, it is possible to reliably prevent the holder from coming off from the inner housing and to reliably assemble the shield shell in the inner housing.

According to the second aspect of the invention, since the pair of the detection portions is respectively provided in one ends of the one shell member on the rear end side in the insertion direction of the holder so as to be opposed to each other with the inner housing interposed therebetween, it is possible to reliably prevent the holder from coming off from the inner housing and to reliably assemble the shield shell in the inner housing.

As described above, according to the first aspect of the invention, since it is possible to prevent the holder from coming off from the inner housing and to reliably assemble the shield shell in the inner housing, it is possible to prevent occurrence of an erroneous assembling operation.

According to the second aspect of the invention, since it is possible to reliably prevent the holder from coming off from the inner housing and to reliably assemble the shield shell in the inner housing, it is possible to prevent occurrence of an erroneous assembling operation.

DESCRIPTION OF THE PREFERRED EMBODIMENTS

Figure 1:
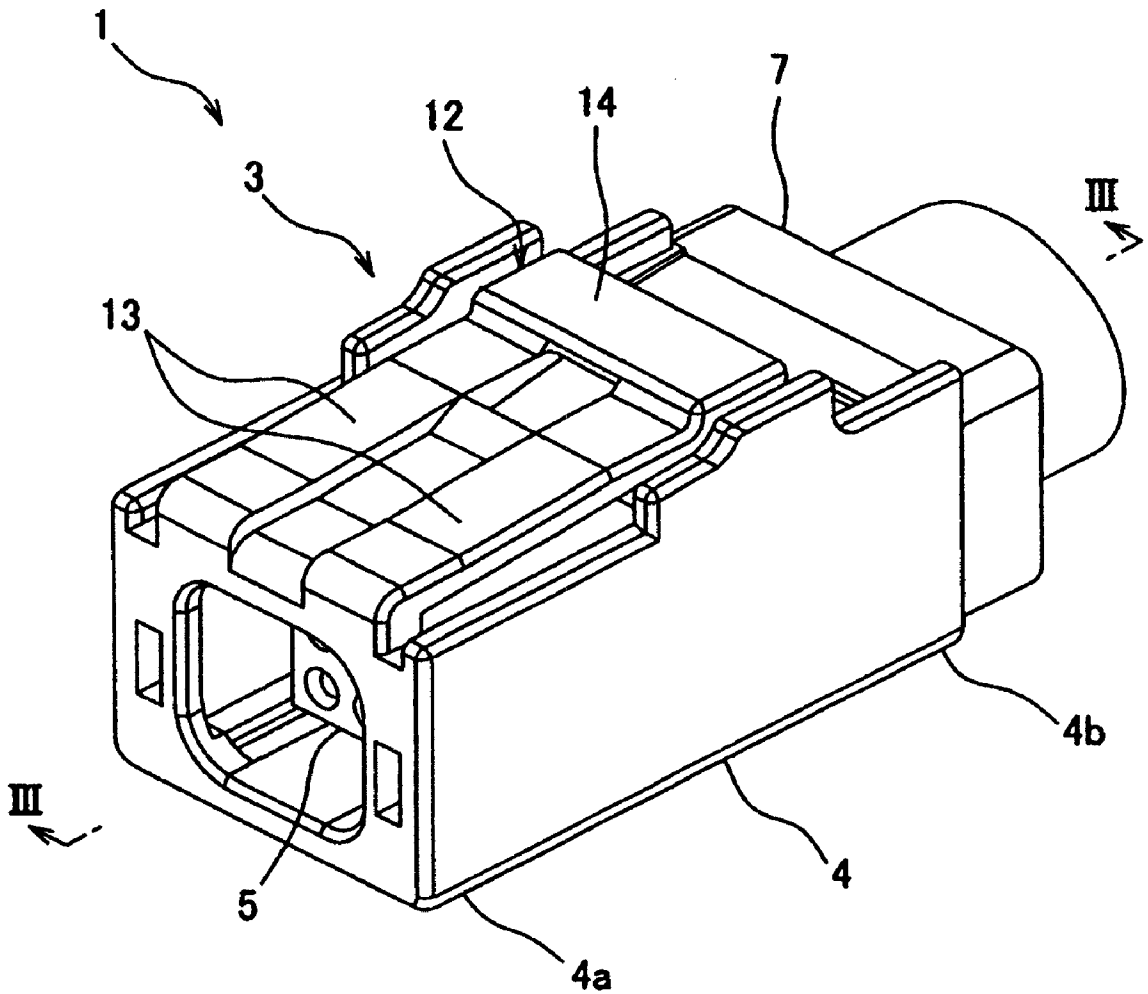
FIG. 1 is a perspective view showing a shield connector according to an embodiment of the invention.
Figure 2:
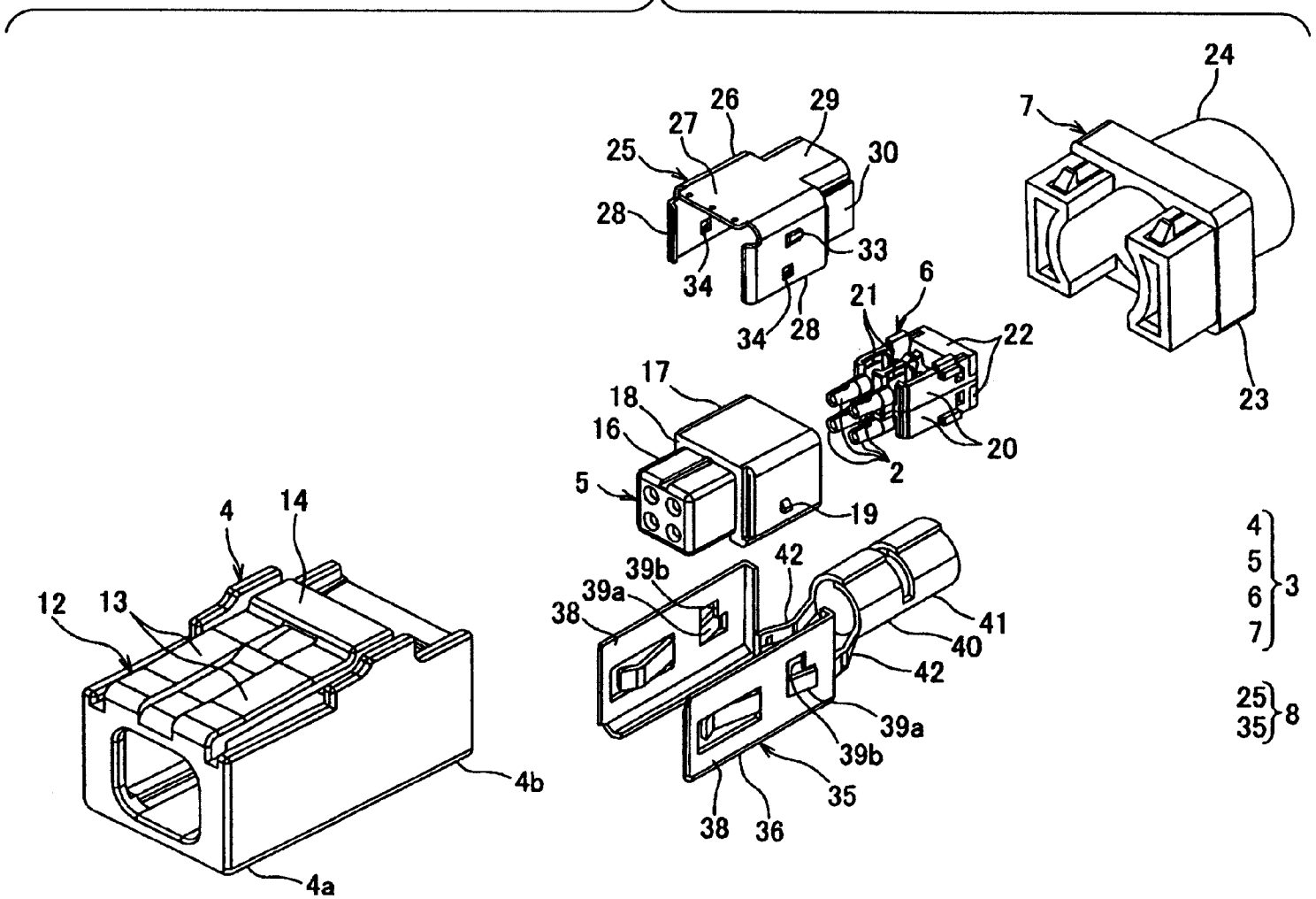
FIG. 2 is an exploded perspective view showing the shield connector of FIG. 1.

Hereinafter, a connector according to an embodiment of the invention will be described with reference to FIGS. 1 to 8. A shield connector 1 according to the embodiment of the invention forms a wire harness which is fitted to an opposite connector (not shown) and is provided in an automobile or the like. As shown in FIG. 1 or 2, the shield connector 1 includes a female-type terminal metal part 2 (hereinafter, referred to as a female terminal), a connector housing 3, and a shield shell 8.

Figure 3:
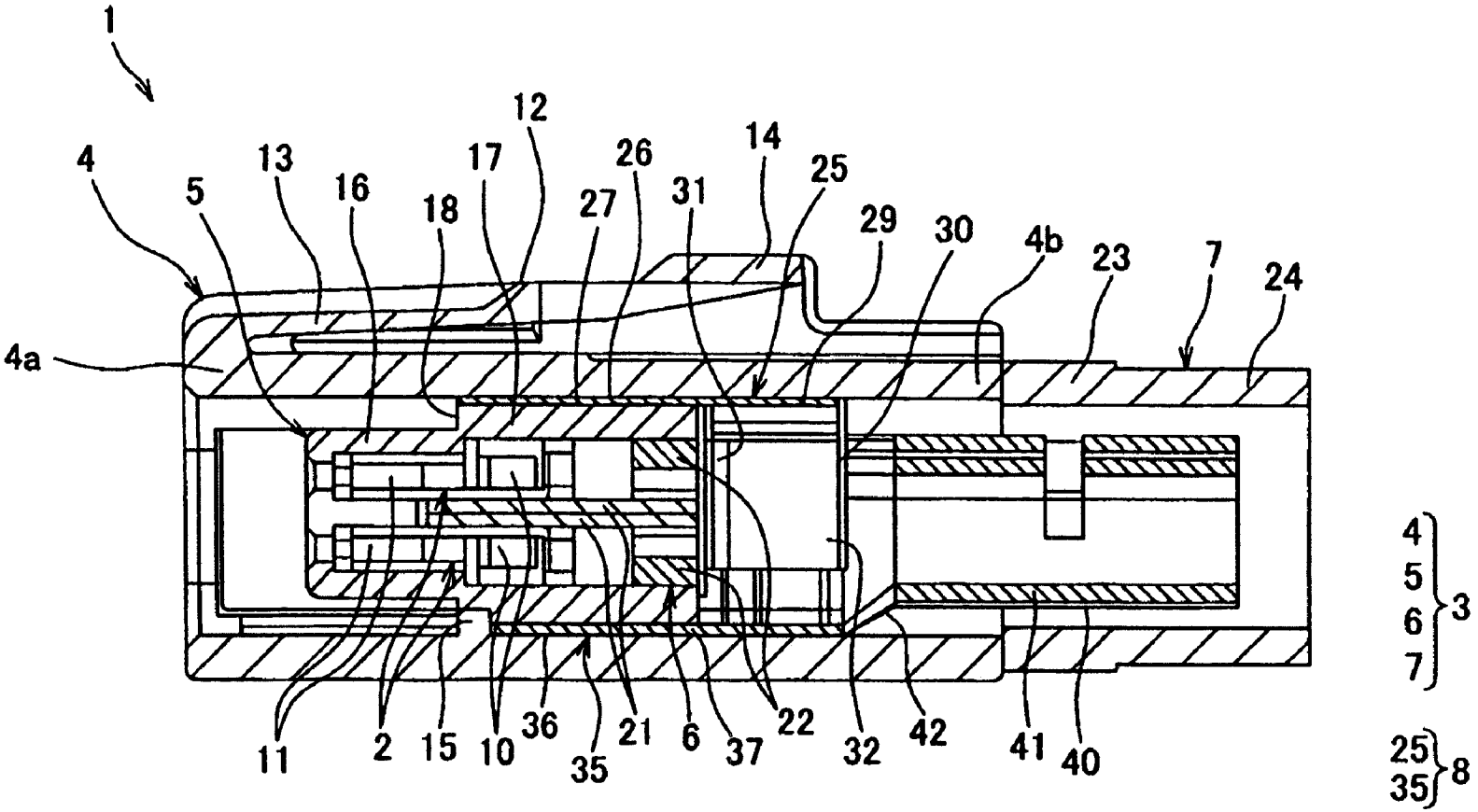
FIG. 3 is a sectional view taken along the line III-III of FIG. 1.

By bending a conductive metal plate, the female terminal 2 is formed. As shown in FIG. 2, plural female terminals 2 are provided (in the example shown in the drawing, the number is four). As shown in FIG. 3, each female terminal 2 is integrally formed with an electric wire connection portion 10 and an electric contact portion 11.

The electric wire connection portion 10 includes plural caulking pieces (not shown), and the plural caulking pieces are used to caulk the terminal of an electric wire (not shown) so as to be electrically connected to the electric wire. The electric contact portion 11 is formed in a tube shape, and is electrically connected to the female terminal in such a manner that an opposite female terminal (not shown) enters the inside of the electric contact portion 11.

As shown in FIG. 2, the connector housing 3 includes a tubular outer housing 4; an inner housing 5 which is accommodated in the outer housing 4; a terminal holder 6 which serves as a holder inserted into the inner housing 5 and holding the female terminal 2; and a rear holder 7.

The outer housing 4 is formed of an insulating synthetic resin. As shown in FIG. 1 or 2, the outer housing 4 is formed in an angular tube shape, and accommodates the inner housing 5 and the shield shell 8. In addition, the outer housing 4 includes a locking arm 12 which protrudes from the outer surface of the outer housing 4 so as to be opposed to an opposite connector housing (not shown) and a locking protrusion portion 15 (shown in FIG. 3) which protrudes from the inner surface of the outer housing 4.

The locking arm 12 includes a pair of arm portions 13 which is connected to the outer housing 4 and extends in a longitudinal direction of the outer housing 4 from one end 4*a* of the outer housing 4 opposed to the connector housing of the opposite connector; and a locking portion 14 which is provided in the outer surface of the pair of arm portions 13 in a convex shape.

The pair of arm portions 13 is disposed in parallel so as to have a gap therebetween, and is elastically deformable so as to be close to the outer surface of the outer housing 4. The locking portion 14 is formed in an angular column shape, and a longitudinal direction thereof is perpendicular to a longitudinal direction of the pair of arm portions 13 so as to connect the front ends of the pair of arm portions 13 to each other.

In the locking arm 12 having the above-described configuration, when the connector housing 3 is fitted to the opposite connector housing (not shown), the locking portion 14 of the locking arm 12 engages with a locking portion of the opposite connector housing, thereby maintaining a fitting state between the connector housing 3 and the opposite connector housing.

As shown in FIG. 3, plural locking protrusion portions 15 protrude from the inner surface of the outer housing 4. The plural locking protrusion portions 15 engage with a below-described step portion 18 of the inner housing 5 and a locking piece 39*a* of a below-described lower shield shell 35 of the shield shell 8.

The inner housing 5 is formed of an insulating synthetic resin. As shown in FIG. 2, the inner housing 5 includes a small diameter portion 16 of which one end is blocked so as to have a rectangular tube shape; a large diameter portion 17 of which an inner diameter and an outer diameter are larger than those of the small diameter portion 16 so as to have a rectangular tube shape; and the step portion 18 which is provided between the small diameter portion 16 and the large diameter portion 17.

The small diameter portion 16 mainly accommodates the electric contact portion 11 of the female terminal 2. The large diameter portion 17 mainly accommodates the terminal holder 6 and the electric wire connection portion 10 of the female terminal 2. In addition, the outer surface of the large diameter portion 17 is attached with a below-described upper shield shell 25 of the shield shell 8, and is provided with plural engagement protrusion portions 19 that engage with engagement holes 34 of the upper shield shell 25. The engagement protrusion portions 19 respectively engage with the engagement holes 34 so as to fix the large diameter portion 17 of the inner housing 5 and the upper shield shell 25 of the shield shell 8.

The terminal holder 6 is formed of an insulating synthetic resin, and includes a pair of holder bodies 20 and a pair of covers 22 that is respectively attached to the pair of holder bodies 20. Each of the pair of holder bodies 20 is formed in a flat plate shape, and is provided with plural terminal accommodation grooves 21 that accommodate the female terminals 2. The plural terminal accommodation grooves 21 is formed in the outer surface of the holder body 20 so as to have a concave shape and is disposed so as to be in parallel to each other. In addition, the pair of holder bodies 20 overlaps with each other so as to be in parallel to each other.

Each of the pair of covers 22 is formed in a cube shape. Each of the pair of covers 22 is attached to each holder body 20 so as to block a side where the electric wire connection portion 10 of the female terminal 2 is disposed in the terminal accommodation groove 21 of each holder body 20.

The terminal holder 6 having the above-described configuration is assembled in such a manner that the pair of holder bodies 20 accommodating the female terminal 2 attached with the electric wire in the terminal accommodation groove 21 is overlaps with each other, and the cover 22 is attached to each of the pair of holder bodies 20. In addition, the terminal holder 6 corresponds to the holder described in "CLAIMS".

The rear holder 7 is formed of an insulating synthetic resin. As shown in FIG. 2, the rear holder 7 includes a rear holder body 23 of which an outer periphery is formed in a rectangular shape and an inner periphery is formed in a tube shape having a circular shape in a sectional view and a cylindrical tube portion 24 which protrudes from an end of the rear holder body away from the outer housing 4. As shown in FIG. 1 or 3, the rear holder body 23 of the rear holder 7 is attached to the other end 4*b* of the outer housing 4 away from the opposite connector housing (not shown), and the electric wire attached to the female terminal 2 passes through the inside of the rear holder body 23 and the tube portion 24.

The shield shell 8 is a pair of shell members that includes the upper shield shell 25 and the lower shield shell 35.

The upper shield shell 25 is formed of a conductive metal material, and is formed by bending, for example, a metal plate or the like. As shown in FIG. 2 or 3, the upper shield shell 25 includes a ceiling plate portion 27 which is formed in a band plate shape; a body portion 26 which is formed in an angular gutter shape (having a U-shape in a sectional view) and includes a pair of side plate portion 28 which is uprightly formed in both ends of the ceiling plate portion 27 in a traverse direction; a connection wall 29 which is connected to the ceiling plate portion 27 of the body portion 26; and an extension wall 30 which extends from the pair of side plate portions 28 of the body portion 26.

In the body portion 26, a width of the body portion 26, that is, a gap between the pair of side plate portions 28 is set to be substantially equal to a width of the large diameter portion 17 of the inner housing 5. In addition, each of the pair of side plate portions 28 of the body portion 26 includes a locking protrusion 33 which is provided in each outer surface of the pair of side plate portions 28 so as to have a convex shape and an engagement hole 34 which is formed through each of the pair of side plate portion 28.

Figure 4:
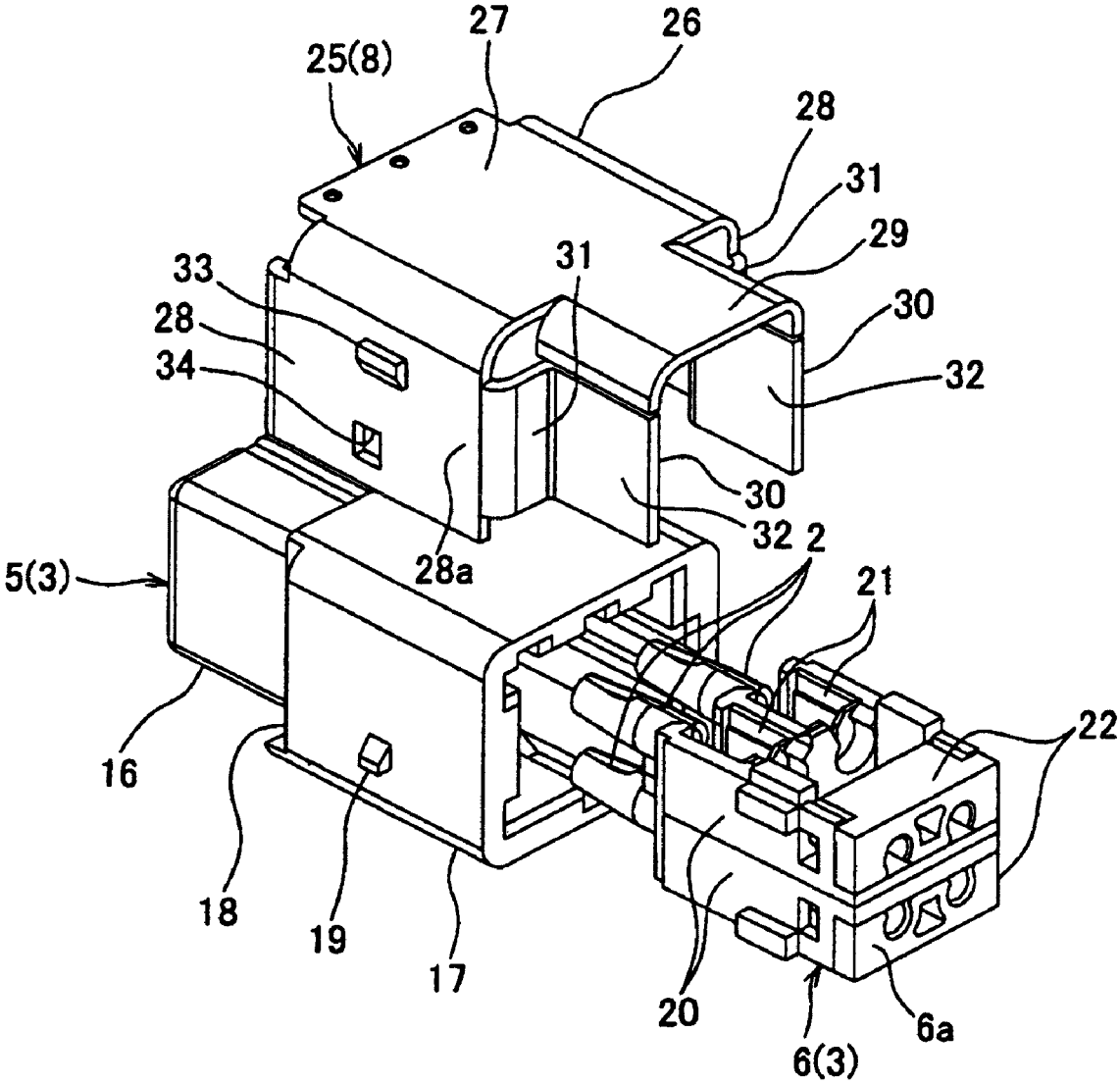
FIG. 4 is a perspective view showing one shield member, a holder, and an inner housing of the shield connector of FIG. 2.

As shown in FIG. 4, the connection wall 29 is connected to the ceiling plate portion 27, and the outer surface of the connection wall 29 and the outer surface of the ceiling plate portion 27 are formed on the same plane. As shown in FIG. 4, the extension wall 30 extends from the pair of side plate portion 28 of the body portion 26, and a pair of extension walls 30 is provided in the body portion 26.

Each of the pair of extension walls 30 extends from one end 28*a* of each side plate portion 28 in a longitudinal direction. When the upper shield shell 25 is attached to the inner housing 5, one end 28*a* of each side plate portion 28 is positioned on the rear end side in a direction in which the terminal holder 6 is inserted into the inner housing 5. The pair of extension walls 30 is opposed in parallel to each other so as to have a gap therebetween. Each of the pair of extension walls 30 includes an overlapping portion 31 and a parallel portion 32.

The overlapping portion 31 is connected to one end 28*a* of the side plate portion 28 and extends to the inside of the body portion 26. The overlapping portion 31 extends from one end 28*a* of the side plate portion 28 in a direction perpendicular to the side plate portion 28. The parallel portion 32 is connected to the overlapping portion 31 and extends in a direction away from the side plate portion 28. The parallel portion 32 is in parallel to the side plate portion 28.

In the upper shield shell 25 having the above-described configuration, the body portion 26 is attached to the large diameter portion 17 so as to cover the upper surface (the upside of FIG. 4) and the pair of side surfaces of the large diameter portion 17 of the inner housing 5, and the connection wall 29 and the pair of extension walls 30 extend outward from a position of the large diameter portion 17 away from the small diameter portion 16, that is, an end on the side where the above-described terminal holder 6 is inserted. In addition, the upper shield shell 25 corresponds to one shell member described in "CLAIMS", and the extension wall 30 corresponds to the detection portion described in "CLAIMS".

The lower shield shell 35 is formed of a conductive metal material, and is formed by bending, for example, a metal plate or the like. As shown in FIG. 2 or 3, the lower shield shell 35 includes a body portion 36 and an electric wire accommodation portion 40 that is connected to the body portion 36.

The body portion 36 is formed in an angular gutter shape (having a U-shape in a sectional view) including a bottom plate portion 37 (shown in FIG. 3) which is formed in a band plate shape and a pair of side plate portions 38 which is uprightly formed in both ends of the bottom plate portion 37 in a transverse direction. Each of the pair of side plate portions 38 is provided with a locking piece 39*a* and a locking hole 39*b*.

The locking piece 39*a* is provided so as to protrude from the outer surface of the side plate portion 38. The locking piece 39*a* is formed in a band plate shape in a longitudinal direction of the side plate portion 38, where one end is connected to the side plate portion 38 and the other end is a free end. The locking piece 39*a* is elastically deformable so that the other end moves close to the side plate portion 38. The locking piece 39*a* engages with the locking protrusion portion 15 of the outer housing 4 so as to fix the lower shield shell 35, that is, the shield shell 8 and the outer housing 4.

The locking hole 39*b* is formed through the side plate portion 38, and is formed in a rectangular shape. The locking hole 39*b* is provided at a position where each side plate portion 38 corresponds to the locking protrusion 33 of the body portion 26 of the upper shield shell 25. When the lower shield shell 35 is attached to the inner housing 5 attached with the upper shield shell 25, the locking hole 39*b* is locked to the locking protrusion 33 of the body portion 26 of the upper shield shell 25, thereby fixing the upper shield shell 25 and the lower shield shell 35 to each other.

The electric wire accommodation portion 40 includes a cylindrical tube portion 41 through which the electric wire attached to the female terminal 2 passes and a connection portion 42 that connects the tube portion 41 to the body portion 36. A pair of the connection portions 42 is formed in a band plate shape and extends from the pair of side plate portions 38 of the body portion 36 on the side of the bottom plate portion 37.

In the lower shield shell 35 having the above-described configuration, the body portion 36 is attached to the inner housing 5 attached with the upper shield shell 25 so as to cover the lower surface (the downside of the drawing) of the inner housing 5 and the pair of side plate portions 28 of the upper shield shell 25, and the electric wire attached to the female terminal 2 is disposed inside the electric wire accommodation portion 40. In addition, the lower shield shell 35 corresponds to the shell member described in "CLAIMS".

The shield connector 1 having the above-described configuration is assembled as below. First, the female terminal 2 attached with the electric wire is accommodated in the terminal accommodation groove 21 of the terminal holder 6 in advance, and the cover 22 is attached to the holder body 20 so that the terminal holder 6 holds the female terminal 2.

Figure 5:
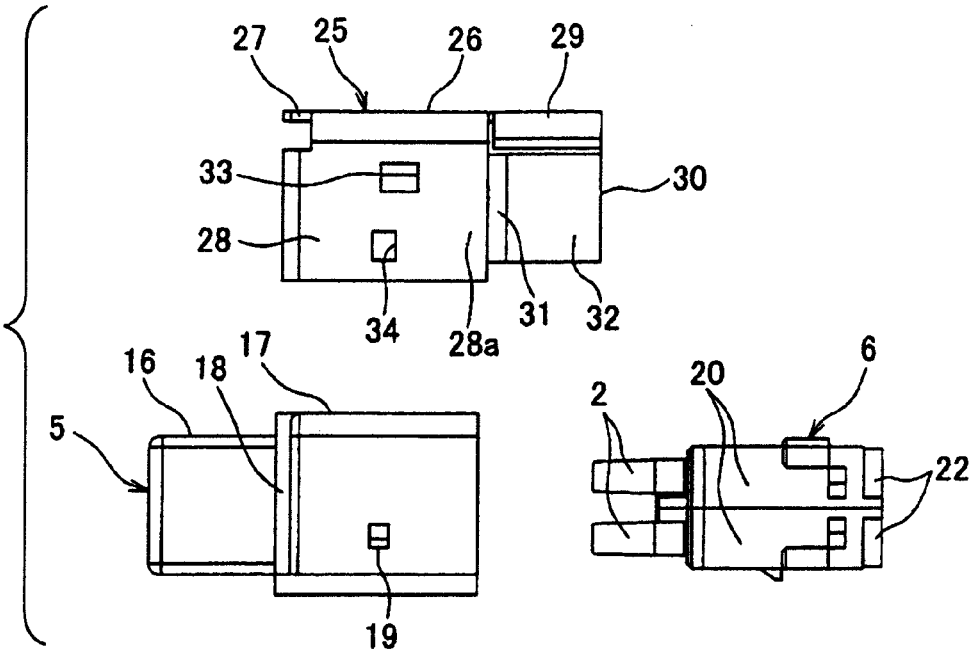
FIG. 5 is an explanatory view showing the state before the holder is inserted into the inner housing shown in FIG. 4.
Figure 6:
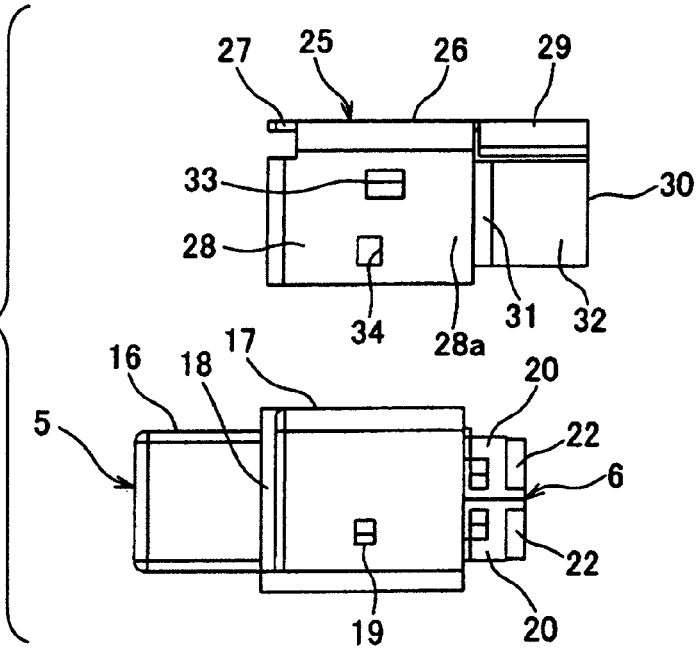
FIG. 6 is an explanatory view showing the state where the holder is being inserted into the inner housing shown in FIG. 5.

Next, as shown in FIG. 5, the terminal holder 6 holding the female terminal 2 is made to be opposed to the large diameter portion 17 of the inner housing 5 away from the small diameter portion 16, and as shown in FIG. 6, the terminal holder 6 is inserted into the inner housing 5. Subsequently, the electric contact portion 11 of the female terminal 2 is positioned to the inside of the small diameter portion 16 of the inner housing 5, and the terminal holder 6 and the electric wire connection portion 10 of the female terminal 2 are positioned to the inside of the large diameter portion 17.

Figure 8:
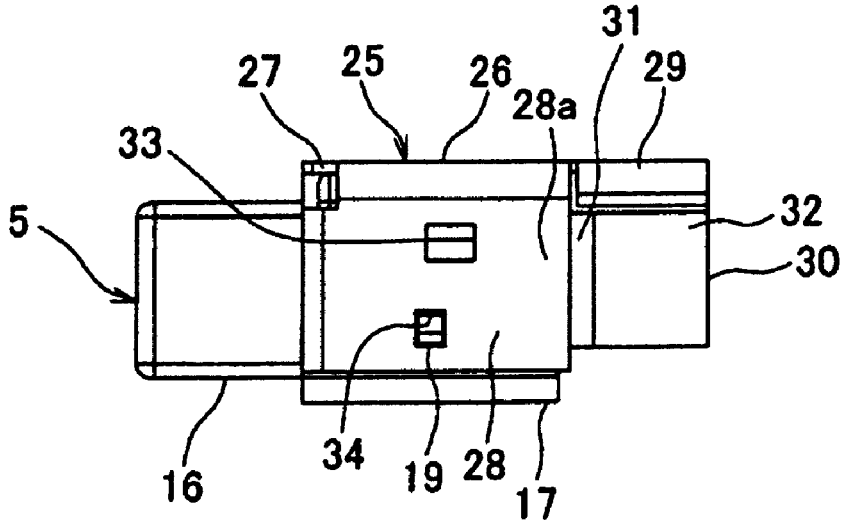
FIG. 8 is an explanatory view showing the state where one shell member is attached to the inner housing, into which the holder shown in FIG. 7 is completely inserted.
Figure 9:
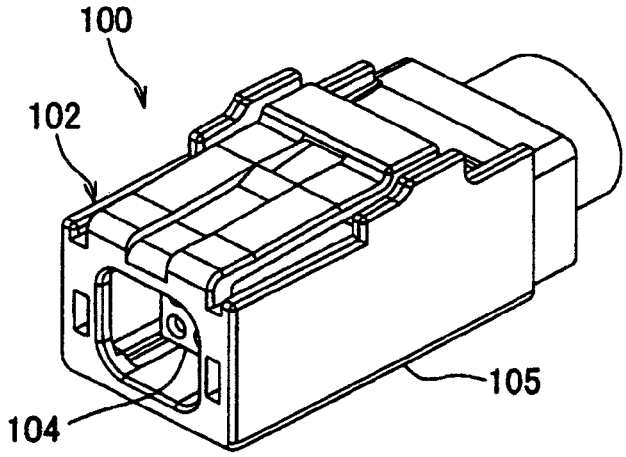
FIG. 9 is a perspective view showing a known shield connector.
Figure 10:
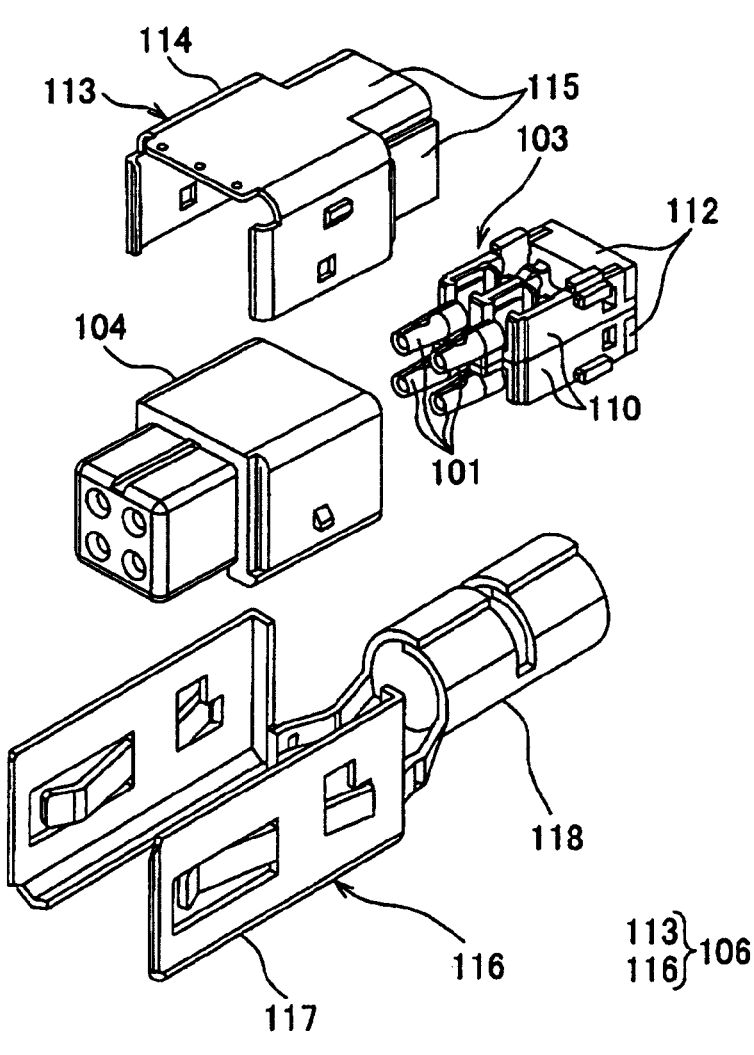
FIG. 10 is an exploded perspective view showing the known shield connector shown in FIG. 9.
Figure 11:
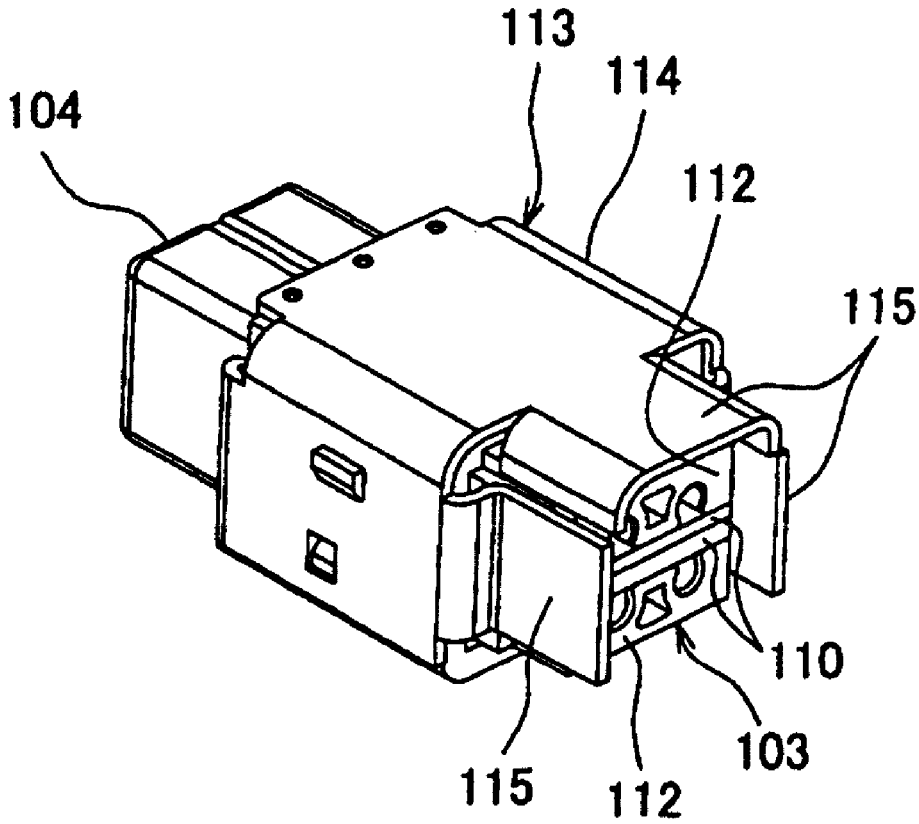
FIG. 11 is a perspective view showing an upper shell, a holder, and an inner housing of the known shield connector shown in FIG. 10.

Subsequently, as shown in FIG. 6, the upper shield shell 25 is positioned to the upper surface side (the upside of the drawing) of the inner housing 5 accommodating the terminal holder 6 and the female terminal 2, and as shown in FIG. 8, the body portion 26 of the upper shield shell 25 is attached so as to cover the upper surface (the upside of FIG. 8) and the pair of side surfaces of the large diameter portion 17 of the inner housing 5. Subsequently, the locking protrusion portion 19 of the inner housing 5 enters the locking hole 34 of the upper shield shell 25 so as to be locked to the locking hole 34, thereby fixing the inner housing 5 and the upper shield shell 25 and attaching the upper shield shell 25 to the inner housing 5.

Figure 7:
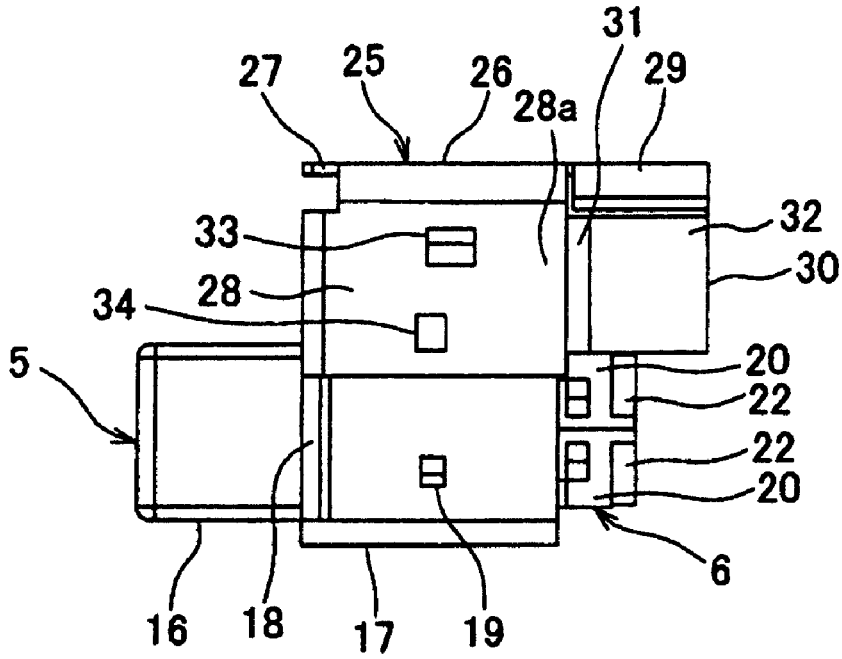
FIG. 7 is an explanatory view showing the state where one shell member is regulated so as not to be attached to the inner housing, into which the holder shown in FIG. 6 is being inserted.

At this time, as shown in FIG. 7, when the upper shield shell 25 is attached to the inner housing 5 in the state where the terminal holder 6 is being inserted into the inner housing 5, the pair of extension walls 30 of the upper shield shell 25 comes into contact with the upper surface (the upside of FIG. 7) of the terminal holder 6 so that the upper shield shell 25 is regulated so as not to be attached to the inner housing 5. Accordingly, since the state where the terminal holder 6 is being inserted into the inner housing 5 is detected, it is possible to prevent the case where the upper shield shell 25 and the shield shell 8 are erroneously assembled in the inner housing 5.

Subsequently, when the upper shield shell 25 is attached to the inner housing 5, the pair of extension walls 30 of the upper shield shell 25 is positioned to the side of the large diameter portion 17 of the inner housing 5 away from the small diameter portion 16. That is, the pair of extension walls 30 of the upper shield shell 25 is positioned to the rear end side in a direction in which the terminal holder 6 is inserted into the inner housing 5. Accordingly, both overlapping portions 31 of the pair of extension walls 30 overlap with a surface 6*a* (shown in FIG. 4) of the terminal holder 6 located on the rear end side in the insertion direction, and the pair of extension walls 30 prevents the terminal holder 6 from moving to the inside of the inner housing 5.

Subsequently, the body portion 36 of the lower shield shell 35 is attached so as to cover the lower surface (the downside of FIG. 2) of the inner housing 5 attached with the upper shield shell 25 and the pair of side plate portions 28 of the upper shield shell 25, and the electric wire (not shown) attached to the female terminal 2 passes through the inside of the electric wire accommodation portion 40 of the lower shield shell 35. Subsequently, the locking protrusion 33 of the upper shield shell 25 enters the locking hole 39*b* of the lower shield shell 35 so as to be locked to the locking hole 39*b*, thereby fixing the upper shield shell 25 and the lower shield shell 35 to each other.

When the upper shield shell 25 and the lower shield shell 35 are attached to each other in this manner, the shield shell 8 is attached to the inner housing 5 so as to cover the outer periphery of the inner housing 5 accommodating the terminal holder 6 and the female terminal 2.

Consequently, the inner housing 5 attached with the shield shell 8 is inserted into the outer housing 4. Accordingly, the step portion 18 of the inner housing 5 engages with the locking protrusion portion 15 of the outer housing 4 so as to prevent the inner housing 5 from coming off from the outer housing 4. In addition, the locking piece 39*a* of the lower shield shell 35 engages with the locking protrusion portion 15 of the outer housing 4 so as to prevent the inner housing 5 from coming off from the outer housing 4.

In addition, after the inner housing 5 and the shield shell 8 are accommodated in the outer housing 4, the rear holder body 23 of the rear holder 7 is attached to the other end 4*b* of the outer housing 4 so that the electric wire attached to the female terminal 2 passes through the inside of the tube portion 24 and the rear holder body 23 of the rear holder 7. In this manner, the shield connector 1 is assembled.

The shield connector 1 assembled as described above is fitted to the opposite connector to thereby form a wire harness provided in an automobile or the like.

According to this embodiment, among the gutter-shaped upper shield shell 25 and the lower shield shell 35 of the shield shell 8 which are attached to each other so as to cover the outer periphery of the inner housing 5, the upper shield shell 25 includes the extension wall 30 which detects the state where the terminal holder 6 is being inserted into the inner housing 5 by overlapping with at least a part of the surface 6*a* of the terminal holder 6 on the rear end side in the insertion direction toward the inner housing 5 in the state where the upper shield shell 25 is attached to the inner housing 5 and by coming into contact with the terminal holder 6 so as to regulate the upper shield shell 25 from being attached to the inner housing 5 in the state where the terminal holder 6 is being inserted into the inner housing 5.

Accordingly, since it is possible to reliably prevent the terminal holder 6 from coming off from the inner housing 5 and to reliably assemble the shield shell 8 in the inner housing 5, it is possible to prevent occurrence of an erroneous assembling operation.

Further, since the pair of extension walls 30 is provided in one end 28*a* of the upper shield shell 25, located on the rear end side in the insertion direction of the terminal holder 6, so as to be opposed to each other with the inner housing 5 interposed therebetween, it is possible to reliably prevent the terminal holder 6 from coming off from the inner housing 5 and to reliably assemble the shield shell 8 in the inner housing 5. Accordingly, it is possible to prevent occurrence of an erroneous assembling operation.

Furthermore, the shield connector 1 according to the invention can be used for different purposes other than the wire harness mounted to an automobile. For example, the shield connector 1 can be used for an electronic device (a television, a personal computer, a surveillance camera, or the like) of a house and the like, a network of a building, or the like.

Moreover, the above-described embodiment is an exemplary embodiment of the invention, but the invention is not limited thereto. That is, various modifications can be made in a range without departing from the spirit of the invention.

What is claimed is:

1. A shield connector, comprising:

plural terminal metal parts;

an insulating connector housing, including a terminal holder therein for holding the plural terminal metal parts and an inner housing through which the holder is to be inserted in an insertion direction; and a conductive shield shell, to be attached to the inner housing;

wherein the shield shell includes a pair of upper and lower shell members that are to be attached to each other so as to cover an outer periphery of the inner housing, wherein one of the upper and lower shell members of the pair of shell members includes an extension wall acting as a detection portion which detects a state where the holder is partially inserted into the inner housing by coming into contact with the holder so as to prevent the one shell member from being attached to the inner housing, wherein the holder has an axial center line which extends in the insertion direction and a rear end side in the insertion direction which extends towards the axial center line, and wherein the detection portion overlaps at least part of the rear end side of the holder when the one shell member is attached to the inner housing and the holder is completely inserted into the inner housing.

2. The shield connector according to claim 1, further comprising another detection portion forming a pair of detection portions, wherein each of the pair of the detection portions is respectively provided on a rear end side of the one shell member in the insertion direction so as to be opposed to each other with the inner housing interposed therebetween.

3. The shield connector according to claim 1, wherein the one shell member has an axial center line which extends in the insertion direction, and wherein the detection portion extends towards the axial center line of the one shell member.

* * * * *